US011648775B2

(12) United States Patent
Maeda et al.

(10) Patent No.: US 11,648,775 B2
(45) Date of Patent: May 16, 2023

(54) LIQUID COATING APPARATUS

(71) Applicant: HEISHIN LTD., Hyogo (JP)

(72) Inventors: Kenji Maeda, Kyoto (JP); Masaji Nakatani, Kyoto (JP); Akira Ishitani, Tottori (JP); Yasushi Nakamura, Tottori (JP); Akihiro Nishimura, Tottori (JP)

(73) Assignee: HEISHIN LTD., Hyogo (JP)

( * ) Notice: Subject to any disclaimer, the term of this patent is extended or adjusted under 35 U.S.C. 154(b) by 236 days.

(21) Appl. No.: 17/312,964

(22) PCT Filed: Aug. 28, 2019

(86) PCT No.: PCT/JP2019/033696
§ 371 (c)(1),
(2) Date: Jun. 11, 2021

(87) PCT Pub. No.: WO2020/066441
PCT Pub. Date: Apr. 2, 2020

(65) Prior Publication Data

US 2022/0048290 A1 Feb. 17, 2022

(30) Foreign Application Priority Data

Sep. 26, 2018 (JP) ..... JP2018-180760

(51) Int. Cl.
*B41J 2/14* (2006.01)
*B05C 5/02* (2006.01)

(52) U.S. Cl.
CPC ..... *B41J 2/14233* (2013.01); *B05C 5/0225* (2013.01)

(58) Field of Classification Search
CPC ..... B41J 2/14233; B41J 2/14; B05C 5/0225; B05C 5/001; B05C 5/0212;
(Continued)

(56) References Cited

U.S. PATENT DOCUMENTS 5,281,885 A 1/1994 Watanabe et al.
2016/0279946 A1* 9/2016 Kobayashi ..... B41J 2/14233

FOREIGN PATENT DOCUMENTS

CN 102962170 A 3/2013
JP 63-130350 A 6/1988
(Continued)

OTHER PUBLICATIONS

IP.com search (Year: 2022).*
Official Communication issued in International Patent Application No. PCT/JP2019/033696, dated Oct. 1, 2019.

*Primary Examiner* — Lisa Solomon
(74) *Attorney, Agent, or Firm* — Hauptman Ham, LLP

(57) ABSTRACT

A liquid coating apparatus includes a liquid chamber, a diaphragm deformable to change a volume of the liquid chamber, a piezoelectric element that deforms the diaphragm in a thickness direction, a pressurized casing bottom-wall portion between the piezoelectric element and the diaphragm to support the piezoelectric element from a diaphragm side, a fixed casing bottom wall portion that supports an end of the piezoelectric element on a side opposite to the diaphragm, a plunger that extends through the pressurized casing bottom-wall portion and transmits expansion and contraction of the piezoelectric element to the diaphragm, and a coil spring that is between the piezoelectric element and the pressurized casing bottom-wall portion and is supported by the first support portion to apply a compressive force to the piezoelectric element.

9 Claims, 3 Drawing Sheets

(58) Field of Classification Search
CPC ..... B05C 11/1013; B05C 11/10; B05C 5/00;
B05B 9/0403; B05B 17/0615
See application file for complete search history.

(56) References Cited

FOREIGN PATENT DOCUMENTS

| | | | |
|---|---|---|---|
| JP | 200033694 | A | 2/2000 |
| JP | 2004-084592 | A | 3/2004 |
| JP | 2007-044627 | A | 2/2007 |
| JP | 2009219993 | A | 10/2009 |
| JP | 2016-059863 | A | 4/2016 |

* cited by examiner

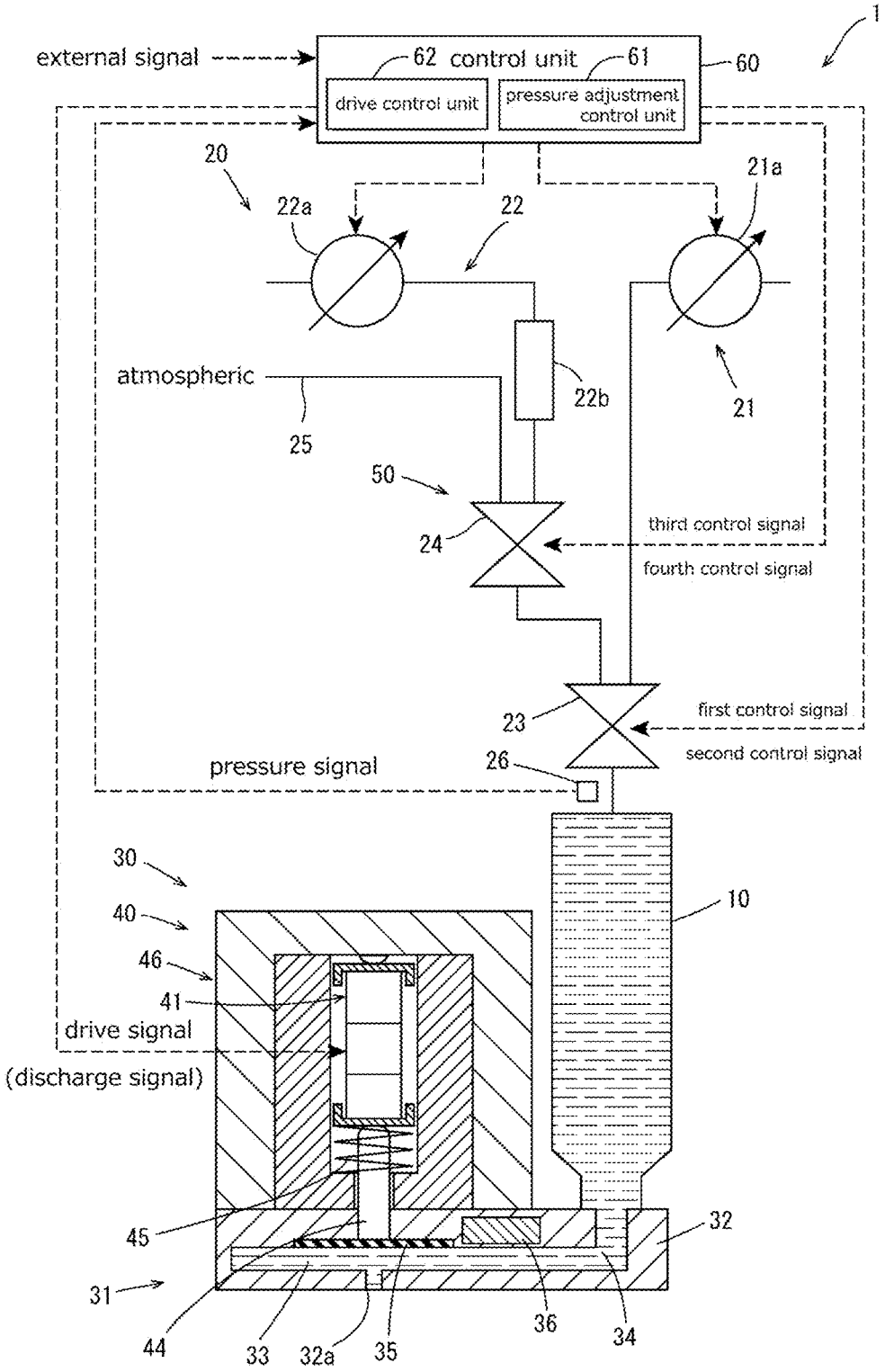
【Fig1】

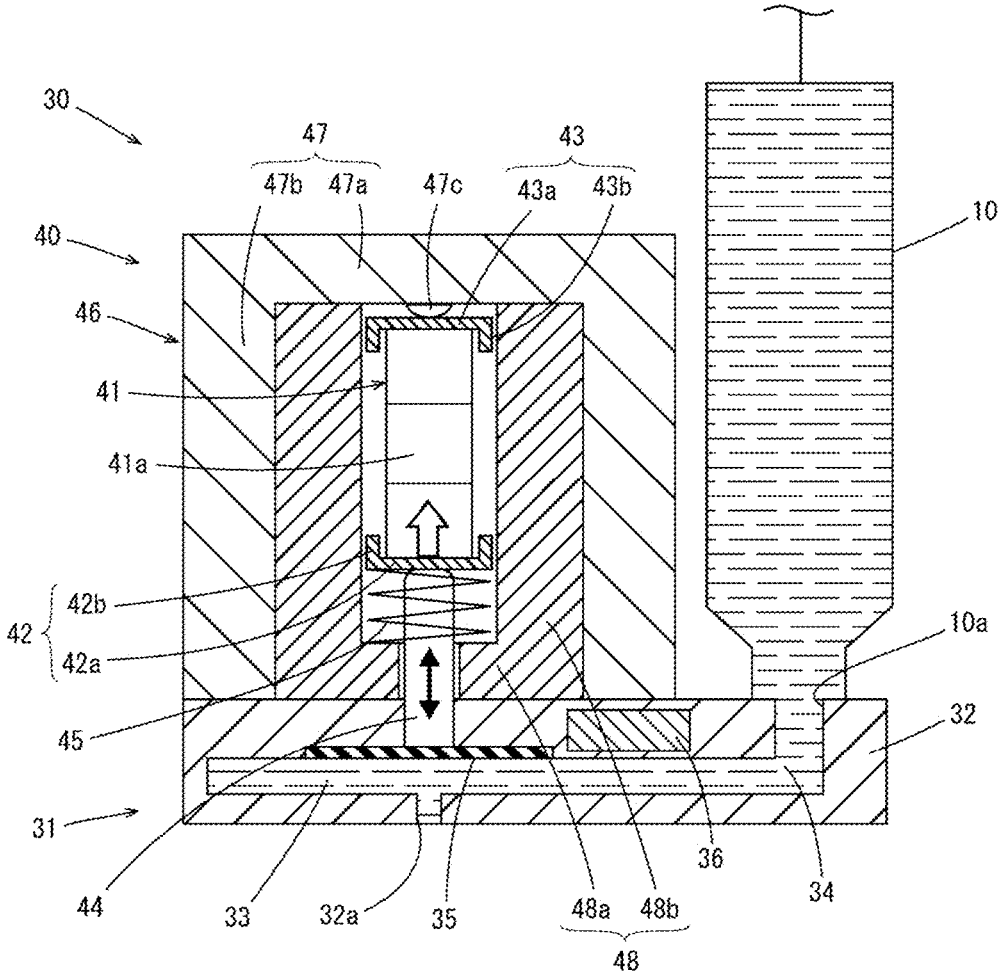
【Fig.2】

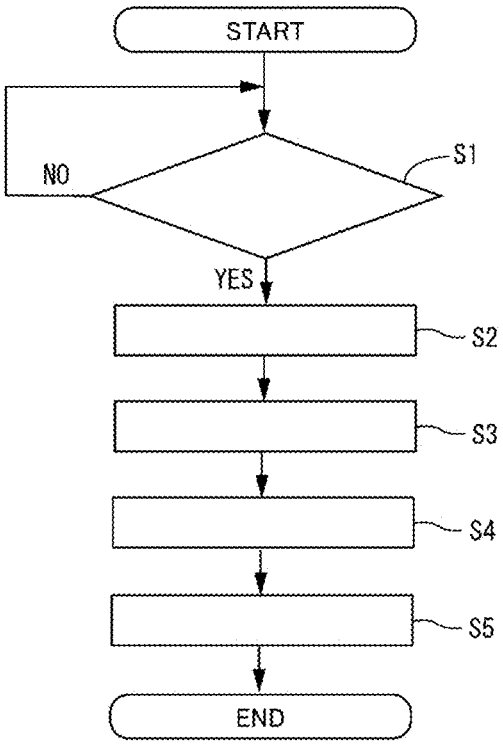
【Fig.3】

LIQUID COATING APPARATUS

CROSS REFERENCE TO RELATED APPLICATIONS

This is a U.S. national stage of PCT Application No. PCT/JP2019/033696, filed on Aug. 28, 2019, with priority under 35 U.S.C. § 119(a) and 35 U.S.C. § 365(b) being claimed from Japanese Patent Application No. 2018-180760, filed on Sep. 26, 2018, the entire disclosures of which are hereby incorporated herein by reference.

FIELD OF THE INVENTION

The present invention relates to a liquid coating apparatus.

BACKGROUND

A liquid coating apparatus is known in which a liquid supplied from a liquid storage assembly is discharged to a material to be coated. Such a liquid coating apparatus changes the volume of a liquid chamber to discharge a liquid in the liquid chamber. As a conventional liquid coating apparatus, there is disclosed an example of the liquid coating apparatus in which the volume of a liquid chamber containing a liquid is changed using a flexible plate that is deformed by driving a piezoelectric element, thereby discharging the liquid through a nozzle.

In the case of a configuration in which a piezoelectric element is driven to deform a flexible body as in the configuration of a conventional liquid coating apparatus, it is conceivable to input a rectangular signal to the piezoelectric element to operate the piezoelectric element at a high speed in order to enhance responsiveness of liquid discharge.

Unfortunately, when a drive element including the piezoelectric element is operated at a high speed, the drive element may excessively expand and contract, and then an excessive load may be applied to the drive element. This may affect the life of the drive element.

SUMMARY

A liquid coating apparatus according to an example embodiment of the present disclosure includes a liquid chamber that stores a liquid, an inflow path that is connected to the liquid chamber to allow the liquid to be supplied into the liquid chamber, a diaphragm that defines a portion of a wall portion defining the liquid chamber and is deformed to change a volume of the liquid chamber, a driver that expands and contracts in at least one direction to deform the diaphragm in a thickness direction, a first support portion that is between the driver and the diaphragm in the one direction to support the driver on a diaphragm side, a second support portion that supports an end of the driver on an opposite side of the driver to the diaphragm in the one direction, a transmission that extends in the one direction between the driver and the diaphragm and passes through the first support portion to transmit expansion and contraction of the driver to the diaphragm, and a compressive force applicator that is between the driver and the first support portion and supported by the first support portion to apply a compressive force to the driver in the one direction.

The liquid coating apparatus according to one example embodiment of the present disclosure prevents an excessive load at a level affecting the life of a driver from being applied to the driver even when the driver is operated at a high speed.

The above and other elements, features, steps, characteristics and advantages of the present disclosure will become more apparent from the following detailed description of the example embodiments with reference to the attached drawings.

BRIEF DESCRIPTION OF THE DRAWINGS

FIG. 1 is a diagram illustrating a schematic configuration of a liquid coating apparatus according to an example embodiment of the present disclosure.

FIG. 2 is an enlarged view illustrating schematic structure of a discharge assembly according to an example embodiment of the present disclosure.

FIG. 3 is a flowchart illustrating an example of operation of a liquid coating apparatus according to an example embodiment of the present disclosure.

DETAILED DESCRIPTION

Hereinafter, example embodiments of the present disclosure will be described in detail with reference to the drawings. The same or corresponding parts in the drawings are designated by the same reference numerals, and description thereof will not be duplicated. Each of the drawings shows dimensions of components that do not faithfully represent actual dimensions of the components and dimensional ratios of the respective components.

FIG. 1 is a diagram schematically illustrating a schematic configuration of a liquid coating apparatus 1 according to an example embodiment of the present disclosure. FIG. 2 is a flowchart illustrating operation of the liquid coating apparatus 1.

The liquid coating apparatus 1 is an ink-jet liquid coating apparatus that discharges a liquid in the form of droplets to the outside. Examples of the liquid include solder, thermosetting resin, ink, and a coating liquid for forming a functional thin film such as an alignment film, a resist, a color filter, and organic electroluminescence.

The liquid coating apparatus 1 includes a liquid storage assembly 10, a pressure adjusting assembly 20, a discharge assembly 30, and a controller 60.

The liquid storage assembly 10 is a container for storing a liquid inside. The liquid storage assembly 10 supplies the stored liquid to the discharge assembly 30. That is, the liquid storage assembly 10 includes an outlet 10*a* for supplying the stored liquid to the discharge assembly 30. Pressure in the liquid storage assembly 10 is adjusted by the pressure adjusting assembly 20. The liquid storage assembly 10 includes a supply port (not illustrated) through which a liquid is supplied thereto.

The pressure adjusting assembly 20 adjusts the pressure in the liquid storage assembly 10 to any one of positive pressure higher than an atmospheric pressure, negative pressure lower than the atmospheric pressure, and the atmospheric pressure. When the pressure in the liquid storage assembly 10 is adjusted in this way, as described later, a liquid can be stably discharged from a discharge port 32*a* of the discharge assembly 30, and the liquid can be prevented from leaking from the discharge port 32*a*.

Specifically, the pressure adjusting assembly 20 includes a positive pressure generator 21, a negative pressure generator 22, a first switching valve 23, a second switching valve 24, an atmospheric opening assembly 25, and a pressure sensor 26.

The positive pressure generator 21 generates positive pressure higher than the atmospheric pressure. The positive pressure generator 21 includes a positive pressure pump 21*a* as a positive pressure generator. The positive pressure pump 21*a* generates positive pressure.

The negative pressure generator 22 generates negative pressure lower than the atmospheric pressure. The negative pressure generator 22 includes a negative pressure pump 22*a* as a negative pressure generator, and a negative pressure adjusting container 22*b*.

The negative pressure pump 22*a* generates negative pressure. Pressure inside the negative pressure adjusting container 22*b* becomes the negative pressure generated by the negative pressure pump 22*a*. The negative pressure adjusting container 22*b* is between the negative pressure pump 22*a* and a second switching valve 24. When the negative pressure generator includes the negative pressure adjusting container 22*b*, the negative pressure generated by the negative pressure pump 22*a* is uniformed.

This enables not only reducing pulsation of the negative pressure generated by the negative pressure pump 22*a*, but also acquiring stable negative pressure in the negative pressure generator 22. As described later, even when output of the negative pressure pump 22*a* changes in accordance with a detection result of pressure in the liquid storage assembly 10 acquired by the pressure sensor 26, the negative pressure adjusting container 22*b* reduces pulsation of negative pressure generated by the negative pressure pump 22*a*, and uniform pressure can be acquired under the negative pressure having changed. Thus, when the negative pressure generator 22 is connected to the liquid storage assembly 10 as described later, pressure in the liquid storage assembly 10 can be quickly set to negative pressure.

The first switching valve 23 and the second switching valve 24 are each a three-way valve. That is, the first switching valve 23 and the second switching valve 24 each have three ports. The first switching valve 23 includes the three ports that are each connected to the corresponding one of the liquid storage assembly 10, the positive pressure generator 21, and the second switching valve 24. The second switching valve 24 includes the three ports that are each connected to the corresponding one of the negative pressure generator 22, the atmospheric opening assembly 25, and the first switching valve 23.

The first switching valve 23 and the second switching valve 24 each allow two ports of the corresponding three ports to be internally connected to each other. In the present example embodiment, the first switching valve 23 allows the port connected to the liquid storage assembly 10 to be connected to the port connected to the positive pressure generator 21 or the port connected to the second switching valve 24. That is, the first switching valve 23 switches between a line connected to the positive pressure generator 21 and a line connected to the second switching valve 24 to connect the switched line to the liquid storage assembly 10. The second switching valve 24 allows the port connected to the first switching valve 23 to be connected to the port connected to the negative pressure generator 22 or the port connected to the atmospheric opening assembly 25. That is, the second switching valve 24 switches between a line connected to the negative pressure generator 22 and a line connected to the atmospheric opening assembly 25 to connect the switched line to the first switching valve 23.

The first switching valve 23 and the second switching valve 24 each switch connection between the corresponding ports in response to an open-close signal output from the controller 60. The open-close signal includes a first control signal, a second control signal, a third control signal, and a fourth control signal, which are described later.

The pressure sensor 26 detects pressure in the liquid storage assembly 10. The pressure sensor 26 outputs the detected pressure in the liquid storage assembly 10 as a pressure signal to the controller 60. Negative pressure to be detected by the pressure sensor 26 changes in accordance with a remaining amount of liquid in the liquid storage assembly 10. That is, when the remaining amount of liquid in the liquid storage assembly 10 decreases, the negative pressure detected by the pressure sensor 26 increases more than when a large amount of liquid remains. The increase in negative pressure means, for example, a state in which the negative pressure has changed from −1 kPa to −1.1 kPa.

The controller 60 described later controls the drive of the negative pressure pump 22*a* in response to a pressure signal output from the pressure sensor 26. When decrease in the remaining amount of liquid in the liquid storage assembly 10 is detected by the pressure sensor 26 as high negative pressure in the liquid storage assembly 10, the controller 60 sets a negative pressure target value lower to bring negative pressure generated by the negative pressure pump 22*a* close to the atmospheric pressure.

The above configuration causes the pressure adjusting assembly 20 to switch the first switching valve 23 to connect the positive pressure generator 21 to the liquid storage assembly 10 when pressure in the liquid storage assembly 10 is made positive, i.e., when the pressure in the liquid storage assembly 10 is pressurized to positive pressure. This enables a liquid to be pushed out from the liquid storage assembly 10 to the discharge assembly 30. Thus, the liquid can be stably supplied to the discharge assembly 30.

When the pressure in the liquid storage assembly 10 is made negative, the pressure adjusting assembly 20 switches not only the second switching valve 24 to connect the negative pressure generator 22 to the first switching valve 23, but also the first switching valve 23 to connect the second switching valve 24 to the liquid storage assembly 10. This enables the liquid to be prevented from leaking from the discharge port 32*a* of the discharge assembly 30 by setting the pressure in the liquid storage assembly 10 to negative pressure.

When the pressure in the liquid storage assembly 10 is set to the atmospheric pressure, the pressure adjusting assembly switches the second switching valve 24 to connect the atmospheric opening assembly 25 to the first switching valve 23. At this time, the first switching valve 23 is in a state in which the second switching valve 24 is connected to the liquid storage assembly 10. This enables the pressure in the liquid storage assembly 10 to be set to the atmospheric pressure.

The discharge assembly 30 discharges the liquid supplied from the liquid storage assembly 10 to the outside in the form of droplets. FIG. 2 is an enlarged view illustrating structure of the discharge assembly 30. Hereinafter, the structure of the discharge assembly 30 will be described with reference to FIG. 2.

The discharge assembly 30 includes a liquid supply assembly 31, a diaphragm 35, and a drive 40.

The liquid supply assembly 31 includes a base 32 provided inside with a liquid chamber 33 and an inflow path 34, and a heater 36. The liquid storage assembly 10 is located on the base 32. The inflow path 34 of the base 32 is connected to an outlet 10*a* of the liquid storage assembly 10. The inflow path 34 is connected to the liquid chamber 33. That is, the inflow path 34 is connected to the liquid chamber 33 and allows the liquid to be supplied from the liquid storage assembly 10 into the liquid chamber 33. The liquid chamber 33 stores the liquid.

The base 32 includes the discharge port 32*a* connected to the liquid chamber 33. The discharge port 32*a* is an opening for discharging the liquid supplied into the liquid chamber 33 to the outside. In the present example embodiment, the discharge port 32*a* opens downward, so that the liquid supplied into the inflow path 34 and the liquid chamber 33 has a liquid level protruding downward caused by a meniscus in the discharge port 32*a*.

The heater 36 is located near the inflow path 34 in the base 32. The heater 36 heats the liquid in the inflow path 34. Although not particularly illustrated, the heater 36 includes, for example, a plate-shaped heater and a heat transfer block. The heater 36 may include another component such as a rod-shaped heater or a Peltier element as long as it can heat the liquid in the inflow path.

Heating the fluid in the inflow path 34 with the heater 36 enables temperature of the liquid to be maintained at a constant temperature higher than room temperature. This enables preventing physical characteristics of the liquid from changing with temperature.

Although not particularly illustrated, the liquid coating apparatus 1 may include a temperature sensor for controlling heating of the heater 36, being located near the heater 36 or near the discharge port 32*a*. The heater 36 may be located on the base 32 as long as the fluid in the inflow path 34 can be heated.

The diaphragm 35 constitutes a part of a wall portion defining the liquid chamber 33. The diaphragm 35 is located on an opposite side to the discharge port 32*a* across the liquid chamber 33. The diaphragm 35 is supported by the base 32 in a deformable manner in its thickness direction. The diaphragm 35 constitutes the part of the wall portion defining the liquid chamber 33, and is deformed to change the volume of the liquid chamber 33. When the diaphragm 35 is deformed in the thickness direction to change the volume of the liquid chamber 33, the liquid in the liquid chamber 33 is discharged to the outside through the discharge port 32*a*.

The drive 40 deforms the diaphragm 35 in the thickness direction. Specifically, the drive 40 includes a piezoelectric element 41, a first base 42, a second base 43, a plunger 44, a coil spring 45, and a casing 46.

The piezoelectric element 41 extends in one direction by receiving predetermined voltage. That is, the piezoelectric element 41 is stretchable in the one direction. The piezoelectric element 41 deforms the diaphragm 35 in the thickness direction by expanding and contracting in the one direction. That is, the piezoelectric element 41 is a driving element that generates a driving force that deforms the diaphragm 35 in the thickness direction. The driving force for deforming the diaphragm 35 in the thickness direction may be generated by another driving element such as a magnetostrictive element.

The piezoelectric element 41 of the present example embodiment has a rectangular parallelepiped shape that is long in the one direction. Although not particularly illustrated, the piezoelectric element 41 of the present example embodiment is formed by electrically connecting multiple piezoelectric bodies 41*a* made of piezoelectric ceramics such as lead zirconate titanate (PZT), being laminated in the one direction. That is, the piezoelectric element 41 includes the multiple piezoelectric bodies 41*a* laminated in the one direction. This enables increasing the amount of expansion and contraction of the piezoelectric element 41 in the one direction as compared with the piezoelectric element 41 including one piezoelectric body. The shape of a piezoelectric element is not limited to a rectangular parallelepiped shape, and another shape such as a columnar shape may be used.

The multiple piezoelectric bodies 41*a* are electrically connected by side electrodes (not illustrated) located opposite to each other in a direction intersecting the one direction. Thus, the piezoelectric element 41 extends in the one direction when the side electrodes receive predetermined voltage. The predetermined voltage applied to the piezoelectric element 41 is a drive signal received from the controller 60 described later.

The structure of the piezoelectric element 41 is similar to that of a conventional piezoelectric element, so that detailed description thereof will be eliminated. The piezoelectric element 41 may have only one piezoelectric body.

The plunger 44 is a rod-shaped member. The plunger 44 has one end in its axial direction, being in contact with the diaphragm 35. The plunger 44 has the other end in the axial direction, being in contact with the first base 42 described later, the first base 42 covering an end of the piezoelectric element 41 in the one direction. That is, the one direction of the piezoelectric element 41 aligns with the axial direction of the plunger 44. The plunger 44 is between the piezoelectric element 41 and the diaphragm 35. This allows expansion and contraction of the piezoelectric element 41 to be transmitted to the diaphragm 35 via the plunger 44. The plunger 44 is a rod-shaped transmission.

The other end of the plunger 44 is in a hemispherical shape. That is, the plunger 44 is in a rod shape, and has a leading end close to the piezoelectric element 41, being in a hemispherical shape. This enables the expansion and contraction of the piezoelectric element 41 to be reliably transmitted by the diaphragm 35 via the plunger 44.

The piezoelectric element 41 has an end close to the diaphragm 35 in the one direction, the end being covered with the first base 42. The first base 42 is in contact with the plunger 44. The piezoelectric element 41 has an end on an opposite side to the diaphragm 35 in the one direction, the end being covered with the second base 43. The second base 43 is supported by a fixed casing bottom-wall portion 47*a* of a fixed casing 47 described later.

The first base 42 and the second base 43 include bottom portions 42*a* and 43*a*, and vertical wall portions 42*b* and 43*b* located on their outer peripheral sides, respectively. The bottom portions 42*a* and 43*a* each have a size covering corresponding one of end surfaces of the piezoelectric element 41 in the one direction. The vertical wall portions 42*b* and 43*b* are each located covering a part of a side surface of the piezoelectric element 41.

The first base 42 and the second base 43 are each made of a wear-resistant material. At least one of the first base 42 and the second base 43 may be made of a sintered material in order to improve wear resistance. The first base 42 and the second base 43 may be different in hardness from each other.

The piezoelectric element 41 is housed in the casing 46. The casing 46 includes the fixed casing 47 and a pressurized casing 48. The pressurized casing 48 is housed in the fixed casing 47. The piezoelectric element 41 is housed in the pressurized casing 48. The fixed casing 47 and the pressurized casing 48 are fixed with bolts or the like (not illustrated).

The fixed casing 47 has a box shape opening toward the diaphragm 35. Specifically, the fixed casing 47 includes a fixed casing bottom-wall portion 47*a* and a fixed casing side-wall portion 47*b*.

The fixed casing bottom-wall portion 47*a* is located on the opposite side to the diaphragm 35 across the piezoelectric element 41. The fixed casing bottom-wall portion 47*a* includes a hemispherical protrusion 47*c* that supports one of the ends of the piezoelectric element 41 in the one direction. That is, the liquid coating apparatus 1 includes the hemispherical protrusion 47*c* protruding from the fixed casing bottom-wall portion 47*a* toward the piezoelectric element 41 in the one direction and supporting the end of the piezoelectric element 41 on the opposite side to the diaphragm 35. This enables the end of the piezoelectric element 41 on the opposite side to the diaphragm 35 to be supported by the protrusion 47*c* of the fixed casing bottom-wall portion 47*a* without partial contact. Thus, the end of the piezoelectric element 41 on the opposite side to the diaphragm 35 can be more reliably supported by the fixed casing bottom-wall portion 47*a*. The fixed casing bottom-wall portion 47*a* is a second support portion that supports the end of the piezoelectric element 41 on the side opposite to the diaphragm 35 in the one direction.

The second base 43 is between the piezoelectric element 41 and the protrusion 47*c*. That is, the liquid coating apparatus 1 includes the second base 43 between the piezoelectric element 41 and the protrusion 47*c*. This enables the end of the piezoelectric element 41 on the opposite side to the diaphragm 35 to be reliably supported by the protrusion 47*c* with the second base 43 interposed therebetween while the end of the piezoelectric element 41 on the opposite side to the diaphragm 35 is held by the second base 43.

The pressurized casing 48 has a box shape opening toward the opposite side to the diaphragm 35 across the piezoelectric element 41. Thus, in a state where the pressurized casing 48 is housed in the fixed casing 47, a part of the fixed casing bottom-wall portion 47*a* is exposed in the casing 46. The protrusion 47*c* described above is located in the exposed part of the fixed casing bottom-wall portion 47*a*.

The pressurized casing 48 includes a pressurized casing bottom-wall portion 48*a* and a pressurized casing side-wall portion 48*b*.

The pressurized casing bottom-wall portion 48*a* is located close to the diaphragm 35. The pressurized casing bottom-wall portion 48*a* includes a through-hole allowing the plunger 44 to pass therethrough. Thus, the plunger 44 extends in the one direction between the piezoelectric element 41 and the diaphragm 35, and passes through the pressurized casing bottom-wall portion 48*a*, thereby transmitting expansion and contraction of the piezoelectric element 41 to the diaphragm 35.

The pressurized casing bottom-wall portion 48*a* is supported on an upper surface of the base 32. This does not allow force generated by the coil spring 45 described later and sandwiched between the pressurized casing bottom-wall portion 48*a* and the first base 42 to act on the diaphragm 35 supported by the base 32, or allows the force even to act on the diaphragm 35 slightly.

The coil spring 45 described later is held between the pressurized casing bottom-wall portion 48*a* and the first base 42. The pressurized casing bottom-wall portion 48*a* is a first support portion that is between the piezoelectric element 41 and the diaphragm 35 in the one direction and supports the piezoelectric element 41 from a side close to the diaphragm 35.

The pressurized casing side-wall portion 48*b* has an outer surface in contact with an inner surface of the fixed casing side-wall portion 47*b*, and the pressurized casing side-wall portion 48*b* has an inner surface in contact with the vertical wall portions 42*b* and 43*b* of the first base 42 and second base 43, respectively. This enables the first base 42 and the second base 43 to be held by the pressurized casing side-wall portion 48*b*. Thus, even when predetermined voltage is applied to the piezoelectric element 41, deformation of the piezoelectric element 41 in a direction orthogonal to the one direction is reduced.

The above structure allows the piezoelectric element 41 to be sandwiched between the plunger 44 and the protrusion 47*c* of the fixed casing bottom-wall portion 47*a* in the one direction. This enables expansion and contraction of the piezoelectric element 41 to be transmitted to the diaphragm 35 with the plunger 44 when the piezoelectric element 41 expands and contracts in the one direction. Thus, the diaphragm 35 can be deformed in its thickness direction by the expansion and contraction of the piezoelectric element 41. FIG. 2 illustrates movement of the plunger 44 due to the expansion and contraction of the piezoelectric element 41 in the one direction with a solid arrow.

The coil spring 45 is a spring member that spirally extends along the axis in the one direction. The coil spring 45 is sandwiched in the one direction between the first base 42 and the pressurized casing bottom-wall portion 48*a*. The plunger 44 in a rod-like shape passes through inside the coil spring 45 in the axial direction. That is, the first base 42 is between the piezoelectric element 41 and the plunger 44 together with the coil spring 45. The coil spring 45 extends along the axis of the plunger 44 between the piezoelectric element 41 and the pressurized casing bottom-wall portion 48*a*.

This allows the coil spring 45 to apply force to compress the piezoelectric element 41 in the one direction via the first base 42. FIG. 2 illustrates compressive force of the coil spring 45 with a white arrow. The coil spring 45 is a compressive force applying assembly that is between the piezoelectric element 41 and the pressurized casing bottom-wall portion 48*a* and supported by the pressurized casing bottom-wall portion 48*a* to apply a compressive force to the piezoelectric element 41 in the one direction. The compressive force generated by the coil spring 45 preferably allows the first base 42 to be located in contact with the plunger 44 in a state where no voltage is applied to the piezoelectric element 41. For example, the compressive force is preferably 30 to 50% of force generated in the piezoelectric element 41 when rated voltage is applied to the piezoelectric element 41.

When the first base 42 is between the piezoelectric element 41 and the plunger 44 together with the coil spring 45, the expansion and contraction of the piezoelectric element 41 can be stably transmitted to the plunger 44 via the first base 42. At the same time, the compressive force of the coil spring 45 can be stably transmitted to the piezoelectric element 41 via the first base 42.

Here, when the liquid has a high viscosity, the piezoelectric element 41 is required to operate at high speed. Thus, it is conceivable to improve responsiveness of the piezoelectric element 41 by inputting a drive signal with a rectangular wave to the piezoelectric element 41. In this case, when the piezoelectric element 41 expands and contracts at high speed, the piezoelectric element 41 may expand and contract excessively, causing internal damage such as peeling. In particular, when the piezoelectric element 41 has multiple piezoelectric bodies 41*a* laminated in an expansion-contraction direction, high-speed operation of the piezoelectric element 41 tends to cause damage such as peeling inside the piezoelectric element 41. The excessive expansion and contraction of the piezoelectric element 41 means that the amount of expansion and contraction of the piezoelectric element 41 is larger than the maximum amount of expansion and contraction when the rated voltage is applied to the piezoelectric element 41.

In contrast, when the piezoelectric element 41 is compressed in the one direction by the coil spring 45 as in the present example embodiment, damage such as peeling due to expansion and contraction of the piezoelectric element 41 can be prevented from occurring inside the piezoelectric element 41 even when the piezoelectric element 41 receives a drive signal with a rectangular wave. That is, the coil spring 45 can suppress excessive expansion and contraction of the piezoelectric element 41, and can prevent occurrence of internal damage of the piezoelectric element 41 due to its expansion and contraction. This enables improving durability of the piezoelectric element 41.

When the coil spring 45 is between the piezoelectric element 41 and the pressurized casing bottom-wall portion 48*a* as described above, the pressurized casing bottom-wall portion 48*a* can receive elastic restoring force of the coil spring 45. Thus, the diaphragm 35 can be prevented from being deformed by the elastic restoring force of the coil spring 45. This enables preventing a liquid from leaking from the discharge port 32*a* and liquid discharge performance from being deteriorated.

When the plunger 44 passes through inside the coil spring 45 spirally extending along the axis in the axial direction, the plunger 44 and the coil spring 45 can be compactly disposed. This enables the liquid coating apparatus 1 to be miniaturized.

Next, a configuration of the controller 60 will be described below.

The controller 60 controls drive of the liquid coating apparatus 1. That is, the controller 60 controls drive of each of the pressure adjusting assembly 20 and the drive 40.

The controller 60 includes a pressure adjustment controller 61 and a drive controller 62.

The pressure adjustment controller 61 outputs a control signal to the first switching valve 23 and the second switching valve 24 of the pressure adjusting assembly 20. The pressure adjustment controller 61 also outputs a positive pressure pump drive signal to the positive pressure pump 21*a*. The pressure adjustment controller 61 further outputs a negative pressure pump drive signal to the negative pressure pump 22*a*. The pressure adjustment controller 61 outputs the control signal to the first switching valve 23 and the second switching valve 24 to control pressure in the liquid storage assembly 10.

For example, when positive pressure is applied to the liquid storage assembly 10, the pressure adjustment controller 61 outputs a first control signal for connecting the positive pressure generator 21 to the liquid storage assembly 10 to the first switching valve 23. When negative pressure is applied to the liquid storage assembly 10, the pressure adjustment controller 61 outputs a second control signal for connecting the second switching valve 24 to the liquid storage assembly 10 to the first switching valve 23, and outputs a third control signal for connecting the negative pressure generator 22 to the first switching valve 23 to the second switching valve 24. When pressure inside the liquid storage assembly 10 is set to the atmospheric pressure, the pressure adjustment controller 61 outputs the second control signal for connecting the second switching valve 24 to the liquid storage assembly 10 to the first switching valve 23, and outputs a fourth control signal for connecting the atmospheric opening assembly 25 to the first switching valve 23 to the second switching valve 24.

The pressure adjustment controller 61 controls drive of the negative pressure pump 22*a* in response to a pressure signal output from the pressure sensor 26. That is, when driving the negative pressure pump 22*a* does not allow pressure detected by the pressure sensor 26 to reach the negative pressure target value, the pressure adjustment controller 61 sets the negative pressure target value lower and causes the negative pressure pump 22*a* to be driven in accordance with a new negative pressure target value. In this way, when decrease in the remaining amount of liquid in the liquid storage assembly 10 is detected by the pressure sensor 26 as high negative pressure in the liquid storage assembly 10, the pressure adjustment controller 61 sets the negative pressure target value lower to bring negative pressure generated by the negative pressure pump 22*a* close to the atmospheric pressure.

The pressure adjustment controller 61 also controls drive of the positive pressure pump 21*a*. The drive of the positive pressure pump 21*a* is similar to that of a conventional configuration, so that detailed description thereof will be eliminated.

The drive controller 62 controls drive of the piezoelectric element 41. That is, the drive controller 62 outputs a drive signal to the piezoelectric element 41. This drive signal includes a discharge signal.

The discharge signal allows the piezoelectric element 41 to expand and contract to vibrate the diaphragm 35 as described later, thereby discharging the liquid in the liquid chamber 33 to the outside through the discharge port 32*a*.

The controller 60 controls timing of allowing the drive controller 62 to output the discharge signal to the piezoelectric element 41 and timing of outputting the control signals to the pressure adjusting assembly 20.

FIG. 3 is a flowchart illustrating an example of operation of discharging a liquid with the discharge assembly 30 and adjusting pressure in the liquid storage assembly 10 with the pressure adjusting assembly 20. Control of the timing of allowing the drive controller 62 to output the discharge signal to the piezoelectric element 41 and the timing of outputting the control signals to the pressure adjusting assembly 20, the control being performed by the controller 60, will be described.

As illustrated in FIG. 3, the controller 60 first determines whether an external signal instructing discharge is received (step S1). This external signal is received by the controller 60 from a controller or the like higher than the controller 60.

When the controller 60 receives an external signal (YES in step S1), in step S2, the pressure adjustment controller 61 of the controller 60 generates the first control signal for connecting the positive pressure generator 21 to the liquid storage assembly in the first switching valve 23 of the pressure adjusting assembly 20 and outputs it to the first switching valve 23. The first switching valve 23 is driven in response to the first control signal. This causes the inside of the liquid storage assembly 10 to be pressurized to positive pressure. In contrast, when the controller 60 receives no external signal (NO in step S1), the determination in step S1 is repeated until the controller 60 receives an external signal.

After step S2, the drive controller 62 of the controller 60 outputs a discharge signal to the piezoelectric element 44 to discharge the liquid to the discharge assembly 30 through the discharge port 32*a* (step S3).

After the drive controller 62 outputs the discharge signal to the piezoelectric element 44, the pressure adjustment controller 61 may output the first control signal to the first switching valve 23. That is, discharge of the discharge assembly 30 may be performed before pressurization of positive pressure in the liquid storage assembly 10.

After that, the pressure adjustment controller 61 generates the second control signal for connecting the second switching valve 24 to the liquid storage assembly 10 in the first switching valve 23 of the pressure adjusting assembly 20, and outputs it to the first switching valve 23. The pressure adjustment controller 61 also generates the third control signal for connecting the atmospheric opening assembly 25 to the first switching valve 23 in the second switching valve 24, and outputs it to the second switching valve 24 (step S4). The first switching valve 23 is driven in response to the second control signal. The second switching valve 24 is driven in response to the third control signal. This causes the pressure in the liquid storage assembly 10 to be the atmospheric pressure.

Subsequently, the pressure adjustment controller 61 generates the fourth control signal for connecting the negative pressure generator 22 to the first switching valve 23 in the second switching valve 24, and outputs it to the second switching valve 24 (step S5). The second switching valve 24 is driven in response to the fourth control signal. This causes the pressure in the liquid storage assembly 10 to be negative pressure. Thus, the liquid can be prevented from leaking through the discharge port 32*a* of the discharge assembly 30. Then, this flow is ended (END). The controller 60 repeatedly performs the above-mentioned flow as necessary.

When the pressure in the liquid storage assembly 10 is controlled as described above, the liquid can be stably discharged through the discharge port 32*a* at appropriate timing without leakage of the liquid through the discharge port 32*a* of the discharge assembly 30.

The drive controller 62 may repolarize the piezoelectric element 41. The piezoelectric element 41 includes multiple piezoelectric bodies 41*a* that are made of a polarized sintered material and are electrically connected. Thus, the piezoelectric element 41 has characteristics in which when the piezoelectric element 41 is left for a long time without being used or when the piezoelectric element 41 is at a high temperature, for example, an electric field is generated inside the piezoelectric element 41 and the amount of displacement of the piezoelectric element when voltage is applied gradually decreases. When displacement characteristics of the piezoelectric element 41 deteriorate as described above, the piezoelectric element 41 needs to be repolarized to recover the displacement characteristics of the piezoelectric element 41.

When the piezoelectric element 41 is repolarized, the drive controller 62 outputs a drive signal for applying rated voltage to the piezoelectric element 41 for a certain period of time, and then turns off the drive signal for a predetermined period of time. In this case, the drive controller 62 generates, as the drive signal, a drive signal capable of preventing a steep rise and fall of the rated voltage applied to the piezoelectric element 41. The rated voltage is predetermined voltage. The voltage applied to the piezoelectric element 41 by the drive controller 62 when the piezoelectric element 41 is repolarized may be voltage other than the rated voltage of the piezoelectric element 41 as long as the voltage enables repolarization of the piezoelectric element 41.

As described above, the liquid coating apparatus 1 may include the controller 60 that performs drive control of the piezoelectric element 41 and performs a repolarization process of applying the rated voltage to the piezoelectric element 41 for a certain period of time and then setting voltage to be applied to zero.

This enables the displacement characteristics of the piezoelectric element 41 to be recovered without using a dedicated circuit when the controller 60 repolarizes the piezoelectric element 41.

The piezoelectric element 41 may be repolarized at any timing other than timing at which a liquid is discharged, such as when the liquid coating apparatus 1 is started or when the liquid coating apparatus 1 receives an external signal instructing liquid discharge.

The liquid coating apparatus 1 according to the present example embodiment includes the liquid chamber 33 that stores a liquid, the inflow path 34 that is connected to the liquid chamber 33 and allows the liquid to be supplied from the liquid storage assembly 10 into the liquid chamber 33, the diaphragm 35 that constitutes a part of a wall portion defining the liquid chamber 33 and is deformed in a thickness direction to change a volume of the liquid chamber 33, the piezoelectric element 41 that expands and contracts in at least one direction to deform the diaphragm 35 in the thickness direction, the pressurized casing bottom-wall portion 48*a* that is between the piezoelectric element 41 and the diaphragm 35 in the one direction to support the piezoelectric element 41 from a diaphragm 35 side, the fixed casing bottom-wall portion 47*a* that supports an end of the piezoelectric element 41 on the opposite side to the diaphragm 35 in the one direction, the plunger 44 that extends in the one direction between the piezoelectric element 41 and the diaphragm 35 and passes through the pressurized casing bottom-wall portion 48*a* to transmit expansion and contraction of the piezoelectric element 41 to the diaphragm 35, and the coil spring 45 that is between the piezoelectric element 41 and the pressurized casing bottom-wall portion 48*a* and is supported by the pressurized casing bottom-wall portion 48*a* to apply a compressive force to the piezoelectric element 41 in the one direction.

This enables the piezoelectric element 41 to be compressed in one direction in which the piezoelectric element 41 expands and contracts by the coil spring 45. Thus, even when the piezoelectric element 41 is operated with a high response, the piezoelectric element 41 is prevented from excessively expanding and contracting, and thus an excessive load at a level affecting the life of the piezoelectric element 41 can be prevented from being applied to the inside of the piezoelectric element 41. Additionally, the coil spring 45 is supported by the pressurized casing bottom-wall portion 48*a*, so that a force generated by the coil spring 45 is not transmitted to the diaphragm 35. This enables the diaphragm 35 to be prevented from being deformed by the force generated by the coil spring 45.

In particular, the piezoelectric element 41 includes the multiple piezoelectric bodies 41*a* laminated in the one direction. This enables increasing a length of expansion and contraction of the piezoelectric element 41 in the one direction as compared with the piezoelectric element 41 including one piezoelectric body 41*a*. Unfortunately, the multiple piezoelectric bodies 41*a* laminated in the one direction as described above cause an excessive load to be likely to be applied to the inside of the piezoelectric element 41 when the piezoelectric element 41 is operated with a high response to cause the piezoelectric element 41 to be excessively expanded and contracted. In contrast, when the coil spring 45 compresses the piezoelectric element 41 in the one direction as described above, an excessive load at a level affecting the life of the piezoelectric element 41 can be prevented from being applied to the inside of the piezoelectric element 41. That is, the above-described structure is particularly effective in a structure in which the piezoelectric element 41 includes the multiple piezoelectric bodies 41*a* laminated in the one direction.

In the present example embodiment, the plunger 44 has a rod shape extending along the axis. The coil spring 45 extends along the axis of the plunger 44 between the piezoelectric element 41 and the pressurized casing bottom-wall portion 48*a* to apply a compressive force to the piezoelectric element 41 in the one direction.

This enables a compressive force of the coil spring 45 to be applied to the piezoelectric element 41 in a direction in which the piezoelectric element 41 expands and contracts to apply a force to the plunger 44. Thus, even when the piezoelectric element 41 is operated with a high response, the piezoelectric element 41 is prevented from excessively expanding and contracting, and thus an excessive load at a level affecting the life of the piezoelectric element 41 can be prevented from being applied to the inside of the piezoelectric element 41.

In the present example embodiment, the plunger 44 is in a rod shape, and has a leading end in a hemispherical shape on a piezoelectric element 41 side. The liquid coating apparatus 1 includes the protrusion 47*c* in a hemispherical shape protruding from the fixed casing bottom-wall portion 47*a* toward the piezoelectric element 41 in the one direction and supporting the end of the piezoelectric element 41 on the opposite side to the diaphragm 35.

This enables a compression direction by the coil spring to be set to the one direction in which the piezoelectric element 41 expands and contracts, when the piezoelectric element 41 is compressed in the one direction by the coil spring 45. The piezoelectric element 41 is likely to be damaged by a compressive force in a direction other than the one direction. Thus, when the compression direction by the coil spring 45 is set to the one direction as described above, the piezoelectric element 41 can be prevented from being damaged by the compressive force of the coil spring 45. The compression direction by the coil spring 45 does not need to completely align with the one direction, and may be a direction in which the compressive force generated by the coil spring 45 includes a force of a component in the one direction.

Although the example embodiment of the present disclosure is described above, the above-described example embodiment is merely an example for implementing the present disclosure. Thus, the above-described example embodiment can be appropriately modified and implemented within a range without departing from the gist thereof and being limited to the above-described example embodiment.

In the example embodiment, the coil spring 45 compresses the piezoelectric element 41 in one direction. However, when the piezoelectric element can be compressed in one direction, the piezoelectric element may be compressed by a configuration other than a coil spring. That is, although in the above example embodiment, the coil spring 45, which is a spiral spring member, is described as an example of a compressive force applying assembly, besides this, the spiral spring member may be, for example, a so-called coiled wave spring in which a wire rod or a flat plate, having a predetermined length and a wavy shape, is spirally wound. The compressive force applying assembly may have a structure other than the spiral shape as long as the piezoelectric element can be compressed in one direction. The compressive force applying assembly is preferably disposed preventing interference with the plunger regardless of structure.

In the above example embodiment, the plunger 44 passes through the coil spring 45 extending spirally along the axis. However, the placement of the coil spring is not particularly limited as long as the coil spring extends parallel to one direction that is a direction of expansion and contraction of the piezoelectric element with respect to the plunger.

In the above example embodiment, both ends of the piezoelectric element 41 are each covered with the corresponding one of the first base 42 and the second base 43 in one direction in which the piezoelectric element 41 expands and contracts. However, in the one direction, only one of both the ends of the piezoelectric element may be covered with a base. In the one direction, each end of the piezoelectric element may not be covered with a base.

In the above example embodiment, the piezoelectric element 41 is supported by the protrusion 47*c* in a hemispherical shape of the fixed casing bottom-wall portion 47*a* and the leading end in a hemispherical shape of the plunger 44 on the piezoelectric element 41 side. However, the liquid coating apparatus may not have at least one of the protrusion in a hemispherical shape and the leading end in a hemispherical shape of the plunger as long as the direction of expansion and contraction of the piezoelectric element is parallel to the compression direction of the coil spring. The shape of each of the protrusion and the leading end of the plunger is not limited to the hemispherical shape, and may be any shape as long as the shape can support the piezoelectric element.

In the above example embodiment, the casing 46 housing the piezoelectric element 41 includes the pressurized casing 48 housed in the fixed casing 47. However, the casing may not include a pressurized casing. In this case, the piezoelectric element is housed in the fixed casing. The coil spring has an end on a diaphragm side that is supported by the upper surface of the base. That is, an upper wall portion of the base functions as the first support portion.

In the above example embodiment, the discharge assembly 30 includes the heater 36 that heats a liquid in the inflow path 34. However, the discharge assembly may not include the heater.

In the above example embodiment, the pressure adjusting assembly 20 includes the first switching valve 23 that is connected to the liquid storage assembly 10 by switching between a line connected to the positive pressure generator 21 and a line connected to the second switching valve 24, and the second switching valve 24 that is connected to the first switching valve 23 by switching between a line connected to the negative pressure generator 22 and a line connected to the atmospheric opening assembly 25.

However, the pressure adjusting assembly may include a switching valve that connects each of the positive pressure generator, the negative pressure generator, and the atmospheric opening assembly, to the liquid storage assembly. The pressure adjusting assembly may have any configuration as long as the positive pressure generator, the negative pressure generator, and the atmospheric opening assembly can be each connected to the liquid storage assembly.

In the above example embodiment, the liquid storage assembly 10 can be connected to the atmospheric opening assembly by the pressure adjusting assembly 20. However, the pressure adjusting assembly may have a configuration in which the atmospheric opening assembly cannot be connected to the liquid storage assembly.

In the above example embodiment, the liquid storage assembly 10 can be connected to the positive pressure generator 21 by the pressure adjusting assembly 20. However, the liquid coating apparatus may not include a positive pressure generator. That is, the liquid coating apparatus may control pressure in the liquid storage assembly using negative pressure and the atmospheric pressure.

The present disclosure is available for a liquid coating apparatus that discharges a liquid from a discharge assembly.

Features of the above-described preferred example embodiments and the modifications thereof may be combined appropriately as long as no conflict arises.

While example embodiments of the present disclosure have been described above, it is to be understood that variations and modifications will be apparent to those skilled in the art without departing from the scope and spirit of the present disclosure. The scope of the present disclosure, therefore, is to be determined solely by the following claims.

The invention claimed is:

1. A liquid coating apparatus comprising:

a liquid chamber to store a liquid;

an inflow path that is connected to the liquid chamber to allow the liquid to be supplied into the liquid chamber;

a diaphragm that defines a portion of a wall portion defining the liquid chamber and is deformable to change a volume of the liquid chamber;

a driver expandable and contractable in at least one direction to deform the diaphragm in a thickness direction;

a first support portion that is between the driver and the diaphragm in the one direction to support the driver on a diaphragm side;

a second support portion that supports an end of the driver on an opposite side of the driver to the diaphragm in the one direction;

a transmission that extends in the one direction between the driver and the diaphragm and passes through the first support portion to transmit expansion and contraction of the driver to the diaphragm; and a compressive force applicator between the driver and the first support portion and supported by the first support portion to apply a compressive force to the driver in the one direction.

2. The liquid coating apparatus according to claim 1, wherein the driver includes a piezoelectric element; and the piezoelectric element includes multiple piezoelectric bodies laminated in the one direction.

3. The liquid coating apparatus according to claim 1, wherein the transmission has a rod shape extending along an axis; and the compressive force applicator extends along an axis of the transmission between the driver and the first support portion to apply a compressive force to the driver in the one direction.

4. The liquid coating apparatus according to claim 1, wherein the compressive force applicator includes a spring extending spirally along an axis; and the transmission has a rod shape and passes through the compressive force applicator in a direction of the axis.

5. The liquid coating apparatus according to claim 1, wherein the transmission is in a rod shape, and includes a leading end in a hemispherical shape on a driver side.

6. The liquid coating apparatus according to claim 1, further comprising:

a protrusion in a hemispherical shape protruding in the one direction from the second support portion toward the driver and supporting the end of the driver on the opposite side of the driver.

7. The liquid coating apparatus according to claim 1, further comprising:

a first base between the driver, and the transmission and the compressive force applicator.

8. The liquid coating apparatus according to claim 6, further comprising:

a second base between the end of the driver on the opposite side of the driver and the protrusion.

9. The liquid coating apparatus according to claim 1, further comprising:

a controller to perform drive control of the driver and to perform a repolarization process of applying a predetermined voltage to the driver for a certain period of time and then setting voltage to be applied to zero.

* * * * *